United States Patent [19]

Dunlap

[11] Patent Number: 4,973,009

[45] Date of Patent: Nov. 27, 1990

[54] KEY FOR ROLLING SLEEPING BAGS

[76] Inventor: M. Lynn Dunlap, P.O. Box 2754, Twin Falls, Id. 83303

[21] Appl. No.: 427,783

[22] Filed: Oct. 27, 1989

[51] Int. Cl.[5] ..... B65D 35/32; B65H 18/02

[52] U.S. Cl. ..... 242/67.1 R; 242/68; 222/99

[58] Field of Search ..... 242/67.1 R, 68; 222/99, 222/100, 102

[56] References Cited

U.S. PATENT DOCUMENTS

| | | | |
|---|---|---|---|
| 756,132 | 3/1904 | Munson et al. | 242/68 |
| 1,770,946 | 7/1930 | Rostiser | 222/99 |
| 3,533,572 | 10/1970 | Sims | 242/68 |
| 4,301,945 | 11/1981 | Sworkin | 222/100 |
| 4,352,441 | 10/1982 | Rosenlind et al. | 222/99 |

*Primary Examiner*—Stuart S. Levy
*Assistant Examiner*—Steven M. duBois
*Attorney, Agent, or Firm*—Leslie G. Murray

[57] ABSTRACT

A rolling key for rolling up sleeping bags and the like is provided. A pair of tubular plastic rods are pivotally attached at one end, one of the rods being pivotally displaceable to a position parallel to and spaced from the other rod forming an open ended fork or key. A metal hook inserted through holes in the free ends of the rods fastens the free ends together and clamps a sleeping bag securely between the rods. In use the rolling key provides sufficient widthwise rigidity to easily roll the sleeping bag. A handle attached to attached end of the non-pivotable rod allows the rolled sleeping bag to tightly compress the rolled bag in a compact bedroll.

12 Claims, 2 Drawing Sheets

FIG. 3
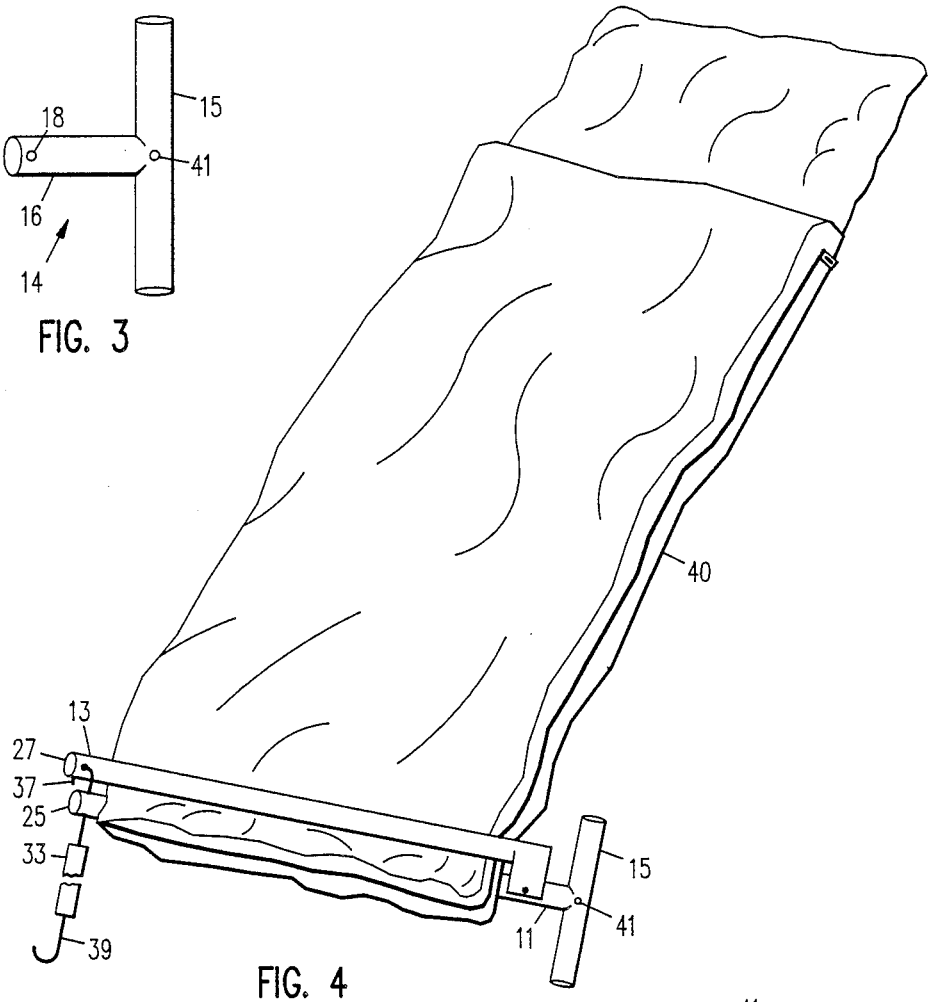
FIG. 4
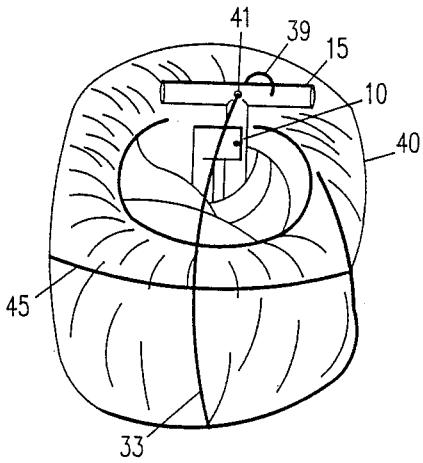
FIG. 5

KEY FOR ROLLING SLEEPING BAGS

BACKGROUND OF THE INVENTION

The present invention relates generally to a winding key for rolling up sleeping bags and the like and more particularly to a winding key having a pivotally mounted clamping bar to clamp the winding key across the end width of a sleeping bag to facilitate rolling of the sleeping bag into a tight bedroll.

Typically, portable bedding such as a sleeping bag for outdoor or other use is stored and transported in a tightly rolled and compact bedroll. It is difficult to maintain sufficient rigidity across the width of a sleeping bag or other bedding during the rolling procedure to avoid producing a loose bundle which tends to come apart and is unhandy to carry. To achieve a tightly rolled, compact bedroll requires considerable time and effort. Further, it is particularly difficult for children to produce a satisfactory bedroll because they lack the strength and patience required to maintain sufficient rigidity across the width of the sleeping bag.

U.S. Pat. No. 3,533,572 entitle, "Mandrel for Rolling Bedding" granted to Rowell W. Sims on Oct. 13, 1970 discloses a pair of elongated slender rods which are placed widthwise over and under bedding and fastened together at corresponding ends securing the thickness of the bedding between the rods to form a clamping mandrel on which to roll the bedding. The described mandrel is constructed of two separate and identical hardwood rods each of which includes a pin protruding from one end and a length of flexible anchoring material such as string or chain attached at the other end. The hardwood rods are disposed in parallel spaced-apart configuration with the thickness of the bedding between the rods and are fastened together at corresponding ends by tying or wrapping the anchoring material about the protruding pins to secure the thickness of the bedding between the rods and provide rigidity across the width of the bedding.

SUMMARY OF THE INVENTION

A sleeping bag key constructed according to the principles of the present invention comprises a first elongated rod having a short cross member at one end forming a T-shaped handle section and a second elongated retaining rod pivotally attached at one end to the first rod at a point adjacent the handle section. The retaining rod is adapted to be pivotally displaced to a position substantially parallel to and in spaced apart relationship with the first rod to enclose and clamp over the thickness of one end of a sleeping bag disposed therebetween. The free ends of the two rods each have a hole formed transversely therethrough to facilitate fastening the ends together to securely hold the sleeping bag or other bedding between the two rods. The sleeping bag key provides a rigid core about which to roll a sleeping bag or other bedding. Once the sleeping bag has been rolled into a loose bedroll, use of the handle section to continue rotation of the key in the same direction that the sleeping bag was rolled produces a tightly rolled, compact bedroll.

The sleeping bag key of the present invention is preferably constructed of lightweight tubular stock of sufficient strength and rigidity, such as schedule 40 PVC plastic pipe, but may be constructed of any suitable material. The two rods are of approximately the same length, the retaining rod being slightly shorter and should be of sufficient length that when clamped in its normal position of use over a sleeping bag to be rolled, with one rod on each side of the end of the unrolled bag and the handle section protruding from one edge of the bag, the free end of the rods at the open end of the key should project from the opposite edge of the bag. The length of the key is variable, but should be correlated to the width of the sleeping bag or bedding to be rolled.

Any convenient fastening means may be used to hold the free ends of the rods together at the open of the key. Preferably, each rod has a hole drilled or otherwise formed in its free end and the wire hook at one end of an elastic cord is inserted through both holes aligning and holding the ends of the rods together and securely holding the thickness of the sleeping bag between the parallel rods of the key. Once the bag has been rolled and compacted, the elastic cord is stretched over the outside of the bag across the width of the bedroll and the wire hook at the cord's other end is inserted through a hole formed transversely through the handle section. A second elastic cord may be stretched around the rolled bag approximately midway between the ends of the rolled bag and its ends hooked together to retain the rolled bag in a tightly rolled and compact bedroll.

When a sleeping bag has been rolled into a tight bedroll as described above, the handle section protrudes from one end of the rolled bag and can used to carry the bag. The rolled bag may be secured to a packframe or placed in a backpack and carried on one's back as when hiking. Alternatively, once a sleeping bag has been rolled and an elastic cord or other suitable means stretched and hooked around the rolled bag, the elastic cord wire hook or other fastening means can be unfastened and removed from the free ends of the two rods and the key withdrawn from the center of the rolled bag. The key can then be used to roll additional sleeping bags.

BRIEF DESCRIPTION OF THE DRAWINGS

FIG. 3 is a perspective view of an alternate handle section for the sleeping bag key shown in FIG. 1.

FIG. 4 is a perspective view illustrating the sleeping bag key of FIG. 1 clamped on the end of a sleeping bag; and FIG. 5 is a perspective view of a rolled sleeping bag produced using the sleeping bag key of FIG. 1.

DETAILED DESCRIPTION OF THE PREFERRED EMBODIMENT

Figure 1:
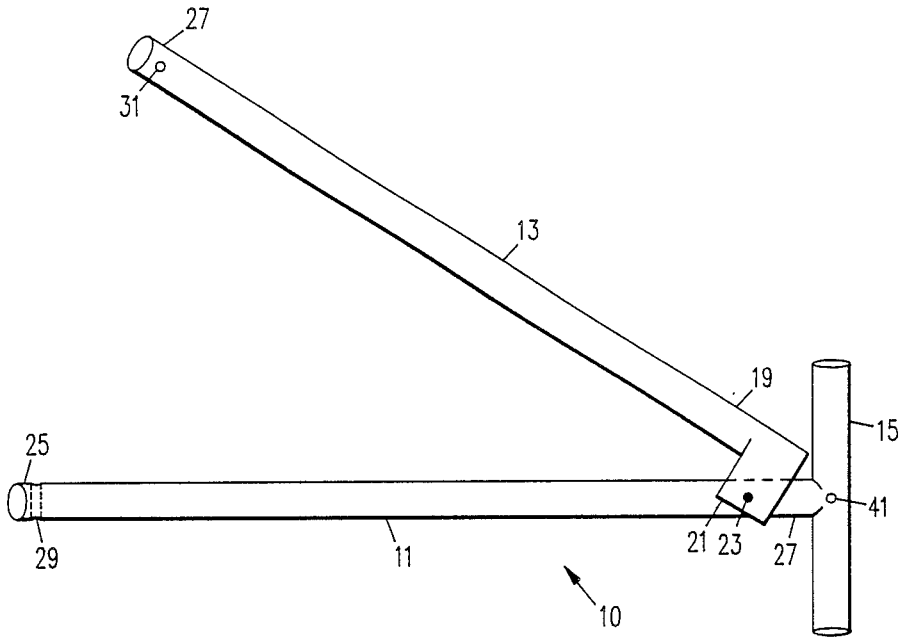
FIG. 1 is a perspective view of a sleeping bag key constructed in accordance with the principles of the present invention.
Figure 2:
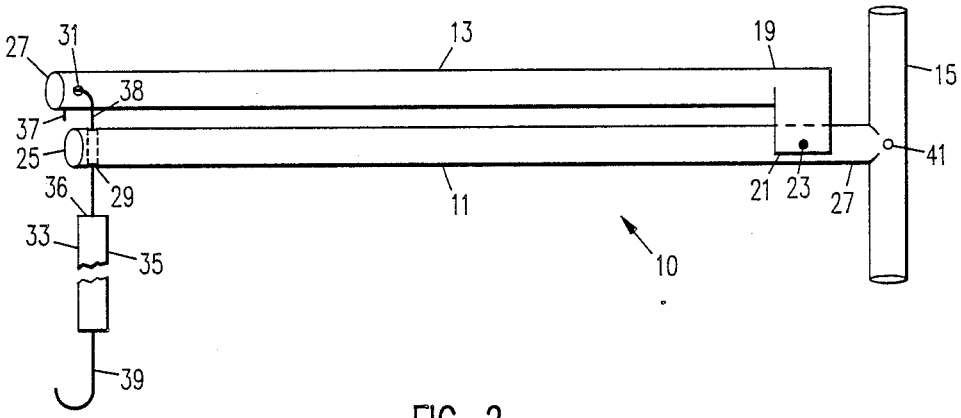
FIG. 2 is a perspective view of the sleeping bag key of FIG. 1 illustrating the use of a wire hook to fasten together the free ends of the key.

Referring to FIGS. 1 and 2, a sleeping bag key 10 constructed in accordance with the principles of the present invention comprises two rigid elongated members 11 and 13 pivotally coupled together at corresponding ends to form an open ended fork or key. A first member 11 includes a short cross member 15 attached at one end 17 forming a T-shaped handle 15 and a second retaining or clamping member 13 is pivotally attached at one end 19 thereof to the corresponding end 17 of the first member 11 adjacent to and slightly spaced from the handle 15. A pair of spaced apart mounting flanges 21 extending perpendicular to the longitudinal axis of the retaining member 13 are formed at the mounting end 19 thereof and receive the end section 17 of the first member 11 therebetween. The retaining member 13 is pivotally coupled to the first member a pivot pin 23, such as a bolt and nut assembly or a cotter pin, inserted through transverse apertures formed in the mounting flanges 21 and the first member end section !7. The retaining member 13 is adapted to be pivotally displaced from an angled position to a position substantially parallel to the first member 11 and spaced from the first member (as shown in FIG. 2). The free ends 25 and 27 of the members 11 and 13 at the open end of the key 10 have holes 29 and 31, respectively, drilled or otherwise formed therethrough to facilitate fastening the two free ends 25, 27 together to retain the two key members 11 and 13 in a parallel, spaced relationship.

Preferably the two key members 11 and 13 are lightweight, rigid tubular stock such as schedule 40 PVC plastic pipe, but may be any material of suitable strength and rigidity. The two elongated members 11 and 13 are preferably sixteen to about thirty-six inches in length depending on the width of the sleeping bag to be rolled. Handle 15 is of the same or material as the elongated members 11, 13 and is glued or otherwise suitably attached to the end section 17 of the first member 11. Alternatively, handle 15 may comprise a T-shaped section 14 (as shown in FIG. 3) having a hole 18 transversely through the end of the center leg 16 of the "T". The center leg 16 is inserted into the open end section 17 and attached to the first member 11 by the pivot pin 23.

The fastening means 33 may be any suitable fastening means which is adapted to quickly and conveniently attach and securely fasten the two free ends 25 and 27 together. Further, the fastening means 33 should also be quickly and easily detached from the ends 25, 27 of the key 10. Preferably, fastening means 33 comprises a resilient cord having an elastic or rubber body section 35 and a wire metal hook 37, 39 fixedly attached at each end of the body section 35. To fasten the two free ends 25, 27 together, the retaining member 13 is pivoted to a parallel position with the first member 11 and one of the end hooks, hook 37 for example, is inserted through the two holes 29 and 31, respectively. The two ends 25 and 27 are then hooked together with the distance separating the key members 11 and 13 limited by the length of the hook shank 38, the first member 11 abutting the shoulder 36 formed at the attachment point of the hook 37 to the cord body 35.

Referring now also to FIGS. 4 and 5, to use the sleeping bag key 10, a sleeping bag 40 to be rolled is laid out flat on the ground or other surface and the first member 11 is placed crosswise under the bag adjacent the end of the bag 40. The retaining member 13 is then pivoted to a position parallel to the first member 11, the end of the sleeping bag 40 disposed between the two key members 11 and 13 with the handle 15 protruding from one edge of the sleeping bag and the free ends 25 and 27 protruding from the opposite edge of the bag. The free ends 25 and 27 are then fastened together by inserting wire hook 37 through the holes 29 and 31, respectively, to tightly clamp the end of the sleeping bag 40 between the key members 12 and 13. The sleeping bag is then rolled in the usual manner bout the key 10 to form a loosely rolled bundle. Using the handle 15, the key 10 is further rotated in the same direction as the bag was rolled to produce a tightly rolled, compact bedroll. Once the sleeping bag 40 is rolled, a second elastic cord 45 is stretched around the rolled bag approximately midway between the ends thereof and hooked together with metal hooks 47 to retain the bag in its rolled condition. The handle 15 may then be used to carry the sleeping bag 40. In the event the rolled bag should loosen up, the roll can be conveniently tightened again by rotating or twisting the handle 15 in the same direction as the bag was originally rolled. Alternatively, the fastening means 33 may be subsequently detached from the key member ends 25, 27 and the key withdrawn from the center of the rolled bag 40 and used to roll additional sleeping bags or stored.

While the present invention has been described and illustrated in its preferred embodiment by way of example, it will be apparent to those skilled in the art that certain changes and improvements may be made therein without deviating from the scope and spirit of the invention as described in the appended claims.

I claim:

1. A rolling key for rolling bedding into a tightly compact bedroll comprising:

first and second rigid elongated members, one end of said second member pivotally attached to said first member adjacent a corresponding end thereof, said second member adapted to be pivotally displaced to a position substantially parallel to said first member in spaced-apart relationship, each of said first and second rigid elongated members having an aperture formed transversely therethrough at a free end thereof;

handle means for rotating said rolling key about its longitudinal axis, said handle means fixedly attached to one end of said first member; and hook means for releasibly fastening together said free ends of said first and second rigid elongated members opposite said corresponding pivotally attached ends thereof, said hook means being adapted to be removably inserted through said apertures in said free ends of said first and second rigid elongated members thereby fastening said free ends together, said hook means being adapted for holding said first and second rigid elongated members in said parallel spaced-apart relationship to clamp bedding of various thickness therebetween.

2. A rolling key as in claim 1 wherein said handle means comprises a short rigid rod fixedly attached crosswise at said corresponding end of said first rigid elongated member.

3. A rolling key as in claim 1 wherein said hook means comprises a pair of hooks, each of said hooks having an elongated shank, said hook means including a resilient cord having one of said pair of hooks fixedly attached to each end thereof.

4. A rolling key as in claim 1 wherein said rigid elongated members comprise tubular rods.

5. A rolling key as in claim 4 wherein said hook means comprises a resilient cord having a hook fixedly attached to at least one end thereof.

6. A rolling key as in claim 5 wherein said resilient cord comprises an elastic cord having a hook fixedly attached at each end thereof.

7. A rolling key as in claim 6 wherein said handle means comprises a length of tubular rod fixedly attached crosswise to said corresponding end of said first tubular rod, said handle having a transverse hole formed therethrough for receiving one of said elastic cord hooks when said bedding is rolled into a bedroll.

8. A rolling key as in claim 4 wherein said handle means comprises a short length of tubular rod fixedly attached crosswise to said corresponding end of said first tubular rod.

9. A rolling key as in claim 8 wherein said second tubular rod is pivotally attached to said first tubular rod by a pivot pin.

10. A rolling key as in claim 9 wherein said second tubular rod includes a pair of spaced-apart flanges extending perpendicular to the longitudinal axis of said second tubular rod formed at said pivotally attached end thereof, said corresponding end of said first tubular rod received between said spaced-apart flanges, said pivot pin extending transversely through said flanges and said first tubular rod to pivotally mount said second tubular rod to said first tubular rod.

11. A rolling key as in claim 10 wherein said handle is fixedly attached to said first tubular rod by said pivot pin.

12. A rolling key as in claim 10 wherein said tubular rods comprise plastic piping.

* * * * *